US007634177B2

(12) United States Patent
Cheng

(10) Patent No.: US 7,634,177 B2
(45) Date of Patent: Dec. 15, 2009

(54) HEAT ISOLATION COVER FOR HEAT BLOWER

(76) Inventor: Chuan-Hsin Cheng, 235 Chung-Ho Box 8-24, Taipei (TW)

( * ) Notice: Subject to any disclaimer, the term of this patent is extended or adjusted under 35 U.S.C. 154(b) by 133 days.

(21) Appl. No.: 11/842,953

(22) Filed: Aug. 22, 2007

(65) Prior Publication Data

US 2009/0052877 A1 Feb. 26, 2009

(51) Int. Cl.
*F24H 1/10* (2006.01)

(52) U.S. Cl. ..... 392/489; 392/385; 219/222

(58) Field of Classification Search ..... 392/385; 219/222

See application file for complete search history.

(56) References Cited

U.S. PATENT DOCUMENTS

| | | | | | |
|---|---|---|---|---|---|
| 3,792,230 | A * | 2/1974 | Ray | 392/410 |
| 3,943,329 | A * | 3/1976 | Hlavac | 392/379 |
| 4,794,225 | A * | 12/1988 | Maese | 392/385 |
| 4,896,020 | A * | 1/1990 | Poweleit | 392/379 |
| 5,157,757 | A * | 10/1992 | McDougall | 392/383 |
| 5,841,943 | A * | 11/1998 | Nosenchuck | 392/385 |
| 6,011,903 | A * | 1/2000 | Nosenchuck | 392/385 |
| 6,205,674 | B1 * | 3/2001 | Kaizuka | 34/96 |
| 6,377,749 | B2 * | 4/2002 | Ohmura | 392/385 |
| 6,389,710 | B1 * | 5/2002 | Chou | 34/97 |
| 6,922,909 | B2 * | 8/2005 | Andrew et al. | 34/96 |
| 7,165,341 | B2 * | 1/2007 | Saida et al. | 34/98 |
| 2005/0229422 | A1 * | 10/2005 | Mattinger et al. | 34/96 |

* cited by examiner

*Primary Examiner*—Thor S Campbell

(57) ABSTRACT

A heat isolation cover for a heat blower comprises a casing having a receiving space; the casing being installed with a protection sleeve, a heat resistance unit and a fan and motor set; one end of the protection sleeve being formed as a converge opening portion; the heat resistance unit having an annular heat isolation unit and a heat emitting unit installed on the heat isolation unit; one end of the heat resistance unit resisting against an inner surface of the guide edge of the protection sleeve and another end thereof being combined to the buckling groove of the casing; and the fan and motor set being installed to a rear end of the heat resistance unit; the actuation of the fan and motor set being controlled by an electronic circuit; and the fan and motor set generating wind to blow the heat resistance unit.

4 Claims, 5 Drawing Sheets

HEAT ISOLATION COVER FOR HEAT BLOWER

BACKGROUND OF THE INVENTION

1. Field of the Invention

The present invention relates to heat blowers, and particularly to a heat isolation cover for a heat blower which has a simple structure. The contact area between the heat resistance unit and the protection sleeve is reduced. The through holes and the protection sleeve will cause the contact temperature and the return heat can be reduced. Thereby cost is low and the assembly work is easy. Thus, the heat blower is a safety device.

2. Description of the Related Art

Referring to FIG. 1, the prior art heat blower 1 is illustrated. The prior art heat blower has a casing 10. An inner tube 13 is installed with the casing 10 by using an annular rib 11 or a metal ring 12. A hollow interior of the inner tube 13 has a high impedance heat resistance unit 14 for generating heat. One end of the inner tube 13 has a fan and motor set 15 having a circuit board. The fan and motor set 15 blows air to the inner tube 13 and the heat resistance unit 14 and hot air flows out from another end of the inner tube 13.

In above mentioned heat blower 1, in actuation, the heat resistance unit 14 will generate heat continuously, even it achieves to 500° C. However, the heat will transfer to the inner tube 13, but the air from the fan and motor set 15 only blows the inner tube 13 and thus the temperature from the heat source can not reduce continuously. Furthermore because the heat accumulates, the casing 10 made of plastics will increase continuously. As a result, it is possible that the casing 10 will melt.

Moreover, the high temperature of the heat blower 1 will make heat accumulate in the inner tube 13, even the power of the heat blower 1 is turned off. However, the heat residue in the heat resistance unit 14 and inner tube 13 will accumulate in the casing 10 without the blowing of the fan and motor set 15. As a result, the heat returns to the casing 10 so as to destroy the casing 10, even the heat transfers to the fan and motor set 15 to burn the circuit of the motor.

Referring to FIG. 2, in one improved structure, a protection sleeve 16 is installed at a periphery of the inner tube 13 of the heat blower 1, the inner tube 13 is assembled to the casing 10 (referring to FIG. 2). An interior surface of the protection sleeve 16 has a plurality of projections 17 resisting against an inner periphery of the inner tube 13 so as to form a gap therebetween. Then the protection sleeve 16 encloses the inner tube 13 and is positioned at a predetermined position of the casing 10. By the protection sleeve 16 and the fan and motor set 15, the heat of the heat blower 1 can be reduced effectively. The contact points between the protection sleeve 16 and the inner tube 13 will make the heat from the casing 10 reduce so as to prevent the heat blower from high temperature.

However, from above mentioned structure, the heat from the inner tube 13 to the casing 10 will generate high temperature as the heat blower is used for a long time. Furthermore when the heat blower 1 is not used, the residual heat will make the temperature increase. Thus there is a necessity for improving the prior art heat blower.

SUMMARY OF THE INVENTION

Accordingly, the primary object of the present invention is to provide a heat isolation cover for a heat blower which has a simple structure. The contact area between the heat resistance unit and the protection sleeve is reduced. The through holes and the protection sleeve will cause the contact temperature and the return heat can be reduced. Thereby cost is low and the assembly work is easy. Thus, the heat blower is a safety device.

To achieve above object, the present invention provides a heat isolation cover for a heat blower comprising: a casing having a receiving space; the casing being installed with a protection sleeve, a heat resistance unit and a fan and motor set; the protection sleeve being at a front end of the casing and having an approximate cylindrical shape; one end of the protection sleeve being formed as a converge opening portion and another end thereof having a tapered cylindrical body; the opening portion having an opening at a frontmost end thereof; a periphery of the cylindrical body being formed as a space for dissipating heat; a stepped surface being formed between the opening portion and the cylindrical body; the stepped surface being formed with a plurality of through holes; the heat resistance unit having an annular heat isolation unit and a heat emitting unit installed on the heat isolation unit; the front end of the heat resistance unit being combined to the casing; one end of the heat resistance unit resisting against an inner surface of the guide edge of the protection sleeve and another end thereof being combined to the buckling groove of the casing; the fan and motor set being installed to a rear end of the heat resistance unit; the actuation of the fan and motor set being controlled by an electronic circuit; the fan and motor set generating wind to blow the heat resistance unit; then the wind flows out from the opening of the opening portion; the airflow from the fan and motor set blows to the cylindrical body of the protection sleeve and vents out from the through holes so as to reduce the surface temperature of the cylindrical body.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
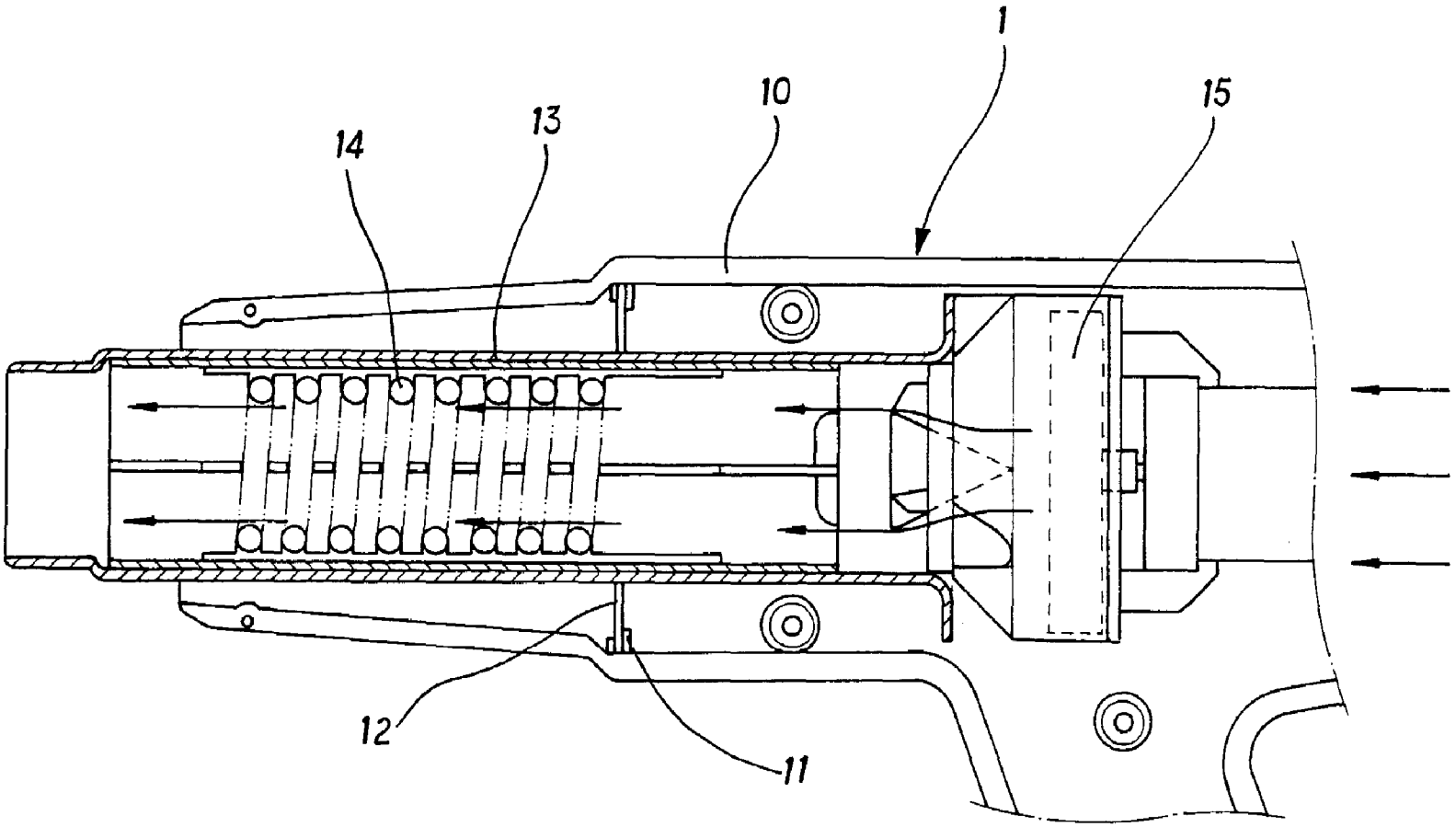
FIG. 1 PRIOR ART
FIG. 1 shows the prior art heat blower.
Figure 2:
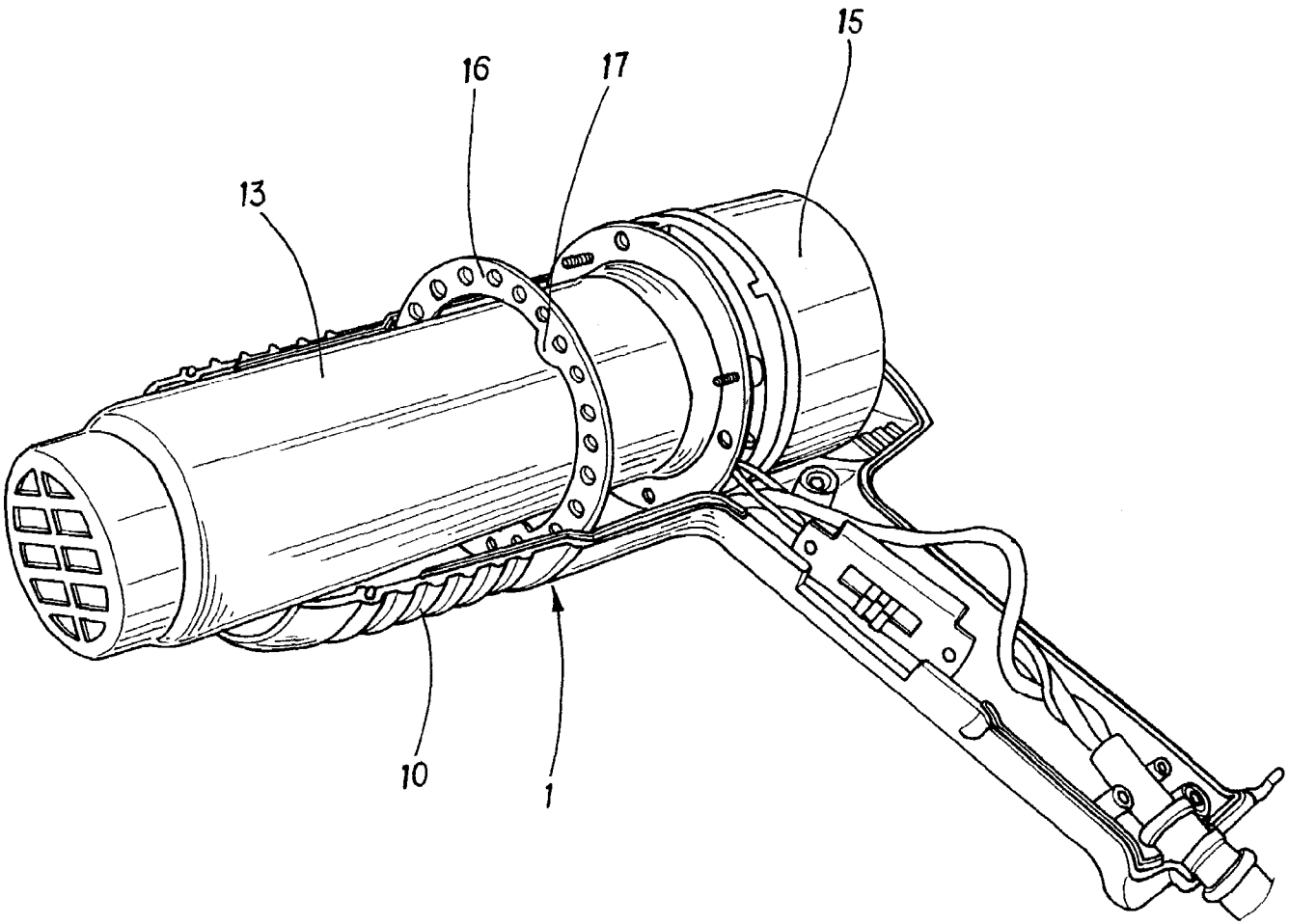
FIG. 2 PRIOR ART
FIG. 2 shows another prior art heat blower.
Figure 3:
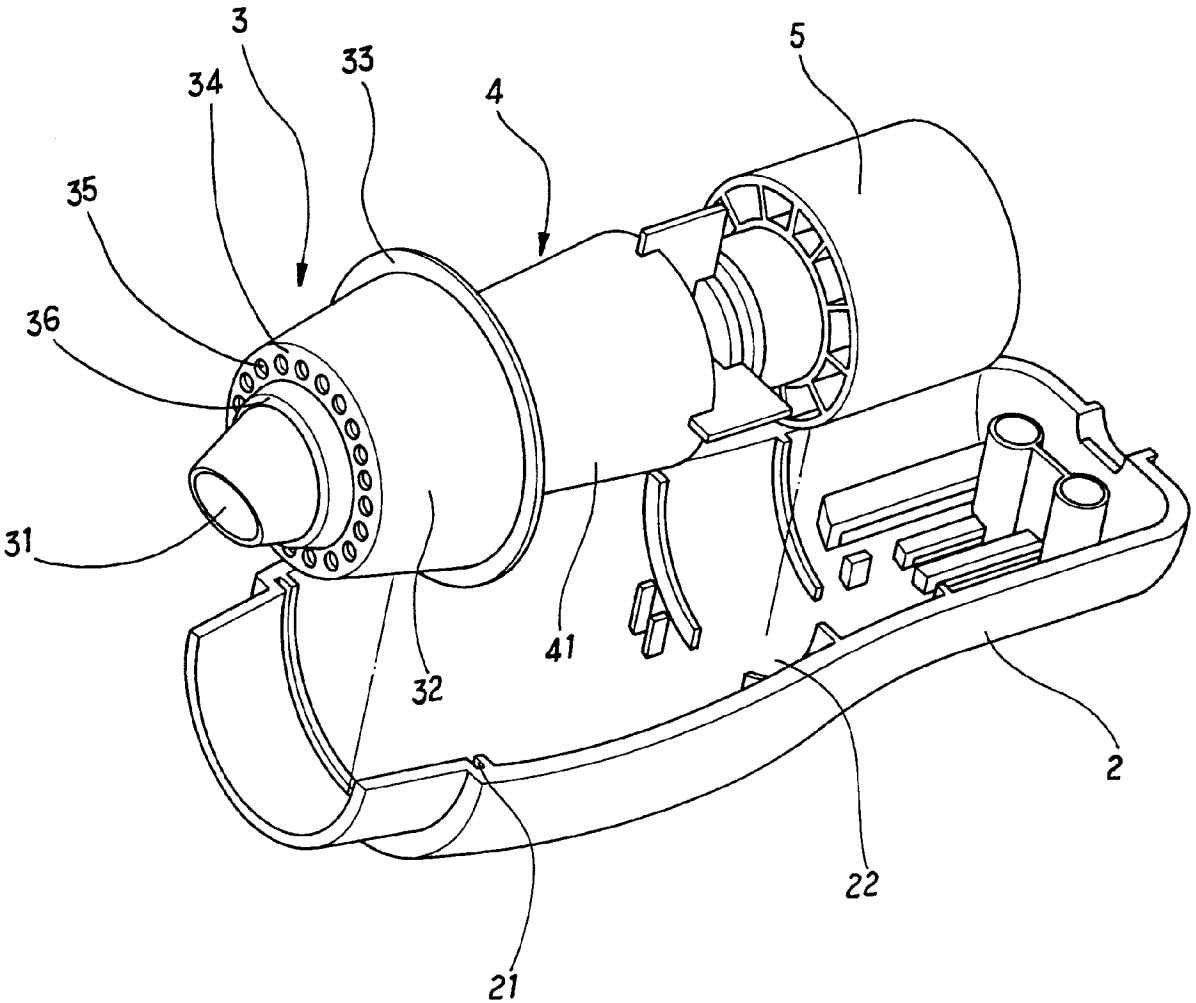
FIG. 3 is an exploded perspective view of the present invention.
Figure 4:
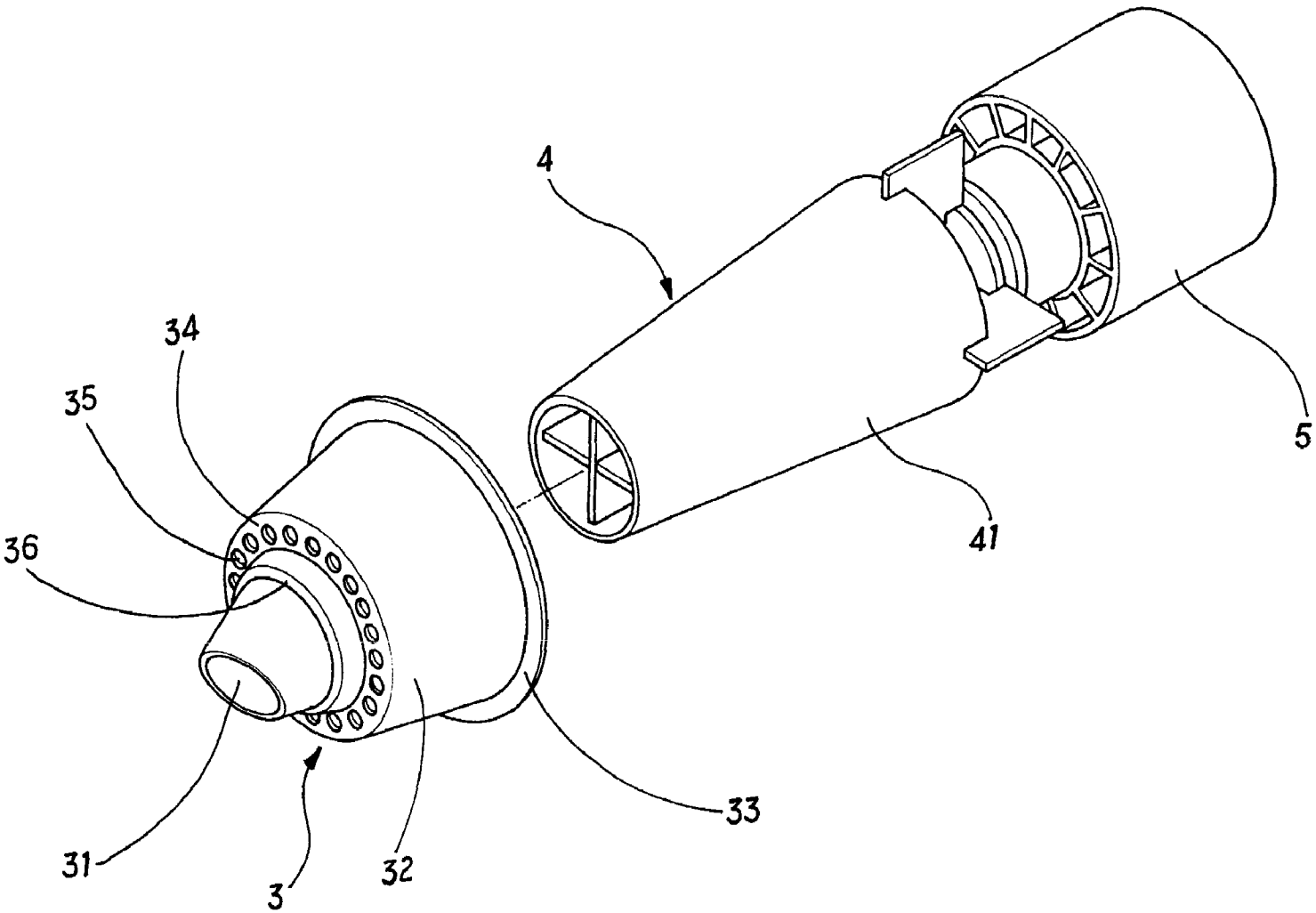
FIG. 4 is an assembled schematic view of the protection sleeve and the heat resistance unit of the present invention.
Figure 5:
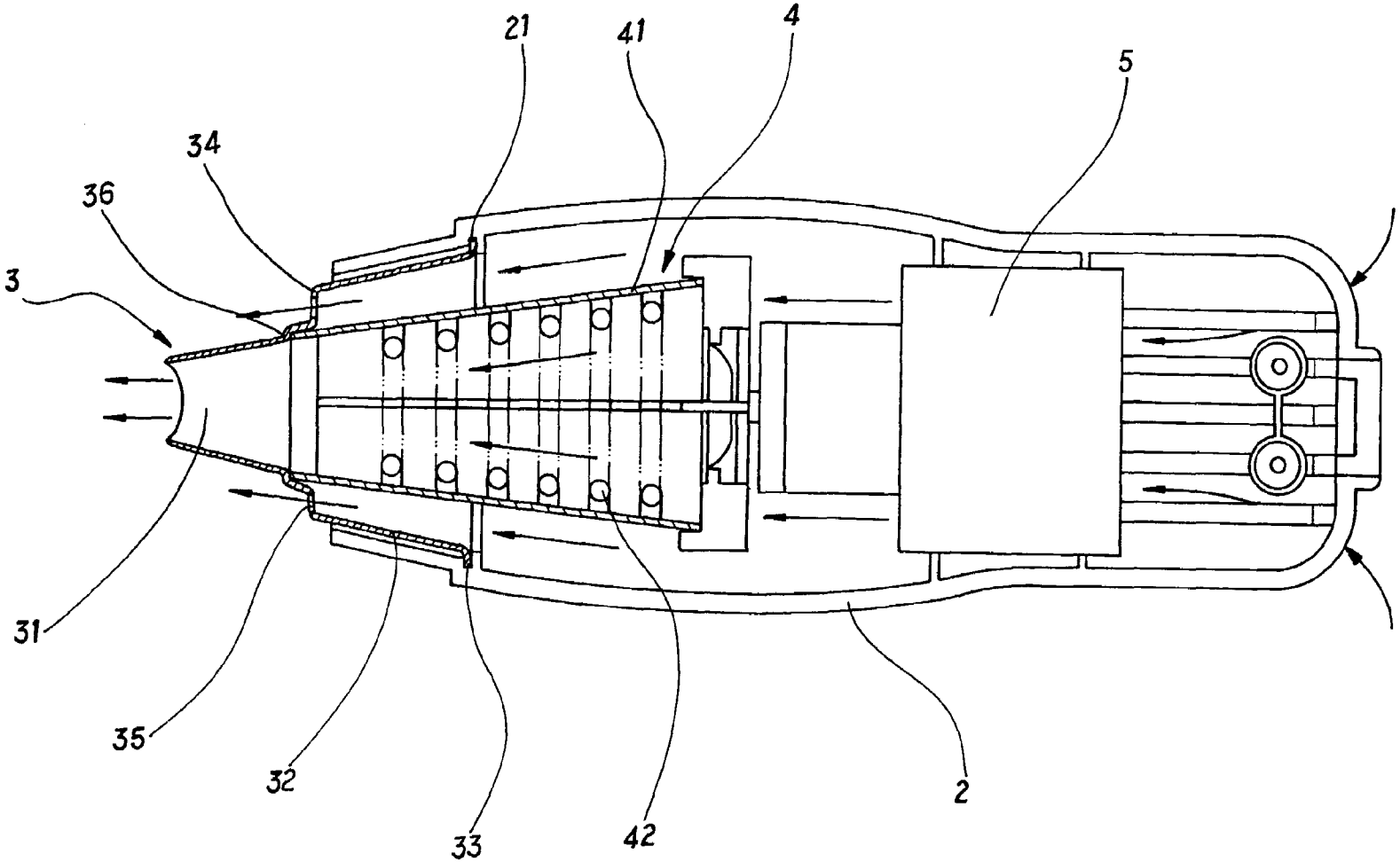
FIG. 5 is a schematic view showing the airflow according to the present invention.

Referring to FIGS. 3 to 5, the heat isolation cover for a heat blower of the present invention is illustrated. The present invention has the following elements.

A casing 2 has a receiving space. The casing 2 is installed with a protection sleeve 3, a heat resistance unit 4 and a fan and motor set 5. An internal of the casing 2 is formed with an annular embedded groove 21 and a buckling groove 22.

The protection sleeve 3 is at a front end of the casing 2 and has an approximate cylindrical shape. One end of the protection sleeve 3 is formed as a converge opening portion 31 and another end thereof has a tapered cylindrical body 32. The opening portion 31 has an opening at a frontmost end thereof. A periphery of the cylindrical body 32 is formed as a space for dissipating heat. A lower end of the protection sleeve 3 is formed with a flange 33. The flange 33 is engaged to the embedded groove 21 of the casing 2. A stepped surface 34 is formed between the opening portion 31 and the cylindrical body 32. The stepped surface 34 is formed with a plurality of through holes 35. A guide edge 36 is formed between the opening portion 31 and the stepped surface 34.

A heat resistance unit 4 has an annular heat isolation unit 41 and a heat emitting unit 42 installed on the heat isolation unit 41. The front end of the heat resistance unit 4 is combined to the casing 2. One end of the heat resistance unit 4 resists against an inner surface of the guide edge 36 of the protection sleeve 3 (referring to FIGS. 4 and 5) and another end thereof is combined to the buckling groove 22 of the casing 2.

The fan and motor set 5 is installed to a rear end of the heat resistance unit 4. The actuation of the fan and motor set 5 is controlled by an electronic circuit (not shown). The fan and motor set 5 generates wind to blow the heat resistance unit 4 and passes through the heat emitting unit 42. Then the wind flows out from the opening of the opening portion 31. The airflow from the fan and motor set 5 blows to the cylindrical body 32 of the protection sleeve 3 and vents out from the through holes 35 so as to reduce the surface temperature of the cylindrical body 32. Of course, the through holes 35 will reduce heat conduction area. By above two heat conduction properties, the temperature increment of the cylindrical body 32 will become slow, but heat dissipation is quick. Thus the contact temperature between the annular portion 33 and the casing 2 is reduced.

Moreover, when the heat blower is not used, the cylindrical body 32 of the protection sleeve 3 is a low temperature area, and has a predetermined volume for collecting heat. The heat from the opening portion 31 or heat resistance unit 4 will transfer to the cylindrical body 32. The cylindrical body 32 will form a temperature gradient and a predetermined volume is provided for collecting heat. Thus, heat can be dissipated quickly to a safe range. Moreover, the periphery of the cylindrical body 32 causes that no heat returns.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A heat isolation cover for a heat blower comprising:

a casing having a receiving space; the casing being installed with a protection sleeve, a heat resistance unit and a fan and motor set;

the protection sleeve being at a front end of the casing and having an approximate cylindrical shape; one end of the protection sleeve being formed as a converge opening portion and another end thereof having a tapered cylindrical body; the opening portion having an opening at a frontmost end thereof; a periphery of the cylindrical body being formed as a space for dissipating heat; a stepped surface being formed between the opening portion and the cylindrical body; the stepped surface being formed with a plurality of through holes;

the heat resistance unit having an annular heat isolation unit and a heat emitting unit installed on the heat isolation unit; the front end of the heat resistance unit being combined to the casing; one end of the heat resistance unit resisting against an inner surface of the guide edge of the protection sleeve and another end thereof being combined to a buckling groove of the casing;

the fan and motor set being installed to a rear end of the heat resistance unit; actuation of the fan and motor set being controlled by an electronic circuit; the fan and motor set generating wind to blow the heat resistance unit; then the wind flowing out from the opening of the opening portion; the airflow from the fan and motor set blowing to the cylindrical body of the protection sleeve and venting out from the through holes so as to reduce the surface temperature of the cylindrical body; and wherein an internal of the casing is formed with an annular embedded groove; a lower end of the protection sleeve is formed with a flange; the flange being engaged to the embedded groove of the casing.

2. The heat isolation cover for a heat blower as claimed in claim 1, wherein a periphery of the cylindrical body is formed with a heat accumulating space.

3. The heat isolation cover for a heat blower as claimed in claim 1, wherein an internal of the casing is formed with a buckling groove; a lower end of the protection sleeve is formed with a flange; and the flange is engaged to the embedded groove of the casing.

4. The heat isolation cover for a heat blower as claimed in claim 1, wherein a heat resistance unit has an annular heat isolation unit and a heat emitting unit installed on the heat isolation unit.

* * * * *